US006743059B1

(12) United States Patent
Korsunsky et al.

(10) Patent No.: US 6,743,059 B1
(45) Date of Patent: Jun. 1, 2004

(54) ELECTRICAL CONNECTOR WITH IMPROVED CONTACT RETENTION

(75) Inventors: Iosif R. Korsunsky, Harrisburg, PA (US); Brian J. Gillespie, Harrisburg, PA (US); Kevin E. Walker, Hershey, PA (US); Tod M. Harlan, Mechanicsburg, PA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/602,247

(22) Filed: Jun. 23, 2003

(51) Int. Cl.[7] ..... H01R 13/40
(52) U.S. Cl. ..... 439/733.1; 439/857
(58) Field of Search ..... 439/733.1, 857, 439/943, 74, 78, 79, 80, 81, 82, 83, 84, 660, 869, 870, 871, 856, 748, 741, 884, 70, 71, 525

(56) References Cited

U.S. PATENT DOCUMENTS 3,621,444 A * 11/1971 Stein ..... 439/109
5,037,334 A * 8/1991 Viselli et al. ..... 439/733.1
5,064,391 A 11/1991 Buchter
5,112,233 A 5/1992 Lybrand
5,263,882 A 11/1993 Peterson
5,340,320 A * 8/1994 Puerner ..... 439/79
5,362,260 A 11/1994 Peloza
5,403,215 A 4/1995 Buchter et al.
5,639,269 A * 6/1997 Vanbesien et al. ..... 439/741
5,899,775 A 5/1999 Davis et al.
6,171,126 B1 * 1/2001 Wu et al. ..... 439/224
6,425,785 B1 * 7/2002 Azuma ..... 439/733.1
6,439,934 B1 * 8/2002 Yu ..... 439/733.1
6,634,911 B1 * 10/2003 Billman et al. ..... 439/884

* cited by examiner

*Primary Examiner*—Tho D. Ta
*Assistant Examiner*—Edwin A. Leon
(74) *Attorney, Agent, or Firm*—Wei Te Chung

(57) ABSTRACT

An electrical connector (1) includes a housing (10) defining a number of channels (105) and a number of terminals (20) received in the channels. Each channel has an inner face (106) and a pair of step portions (107) oppositely protruding from the inner face. Each terminal includes a body portion (21) having two opposed side edges (213), a pair of spaced-apart legs (22) extending from an end of the body portion, and a tail portion (23) extending from an opposite end of the body portion. Each side edge has a shoulder (212) and a recessed portion (214) under the shoulder. The step portion is depressed and collapsed by the shoulder when the terminal is inserted into the terminal receiving channel and part of the step portion is pressed into the recessed portions of the terminal, thereby securing the terminal in the housing.

2 Claims, 5 Drawing Sheets

ELECTRICAL CONNECTOR WITH IMPROVED CONTACT RETENTION

CROSS-REFERENCE TO RELATED APPLICATIONS

Relevant subject matter is disclosed in co-pending U.S. Patent Applications entitled "MULTI-FUNCTION PICK-UP CAP OF THE ELECTRICAL CONNECTOR" and entitled "ELECTRICAL CONTACT AND METHOD OF MAKING THE SAME", both assigned to the same assignee with this application.

BACKGROUND OF THIE INVENTION

1. Field of the Invention

The present invention generally relates to an electrical connector, and particularly to an electrical connector including conductive terminals insertable into a housing.

2. Description of Prior Arts

Contacts insertable into passageways of housings require assured mechanisms to be retained in the passageways after insertion, resistant to strain. Stamped and formed contacts commonly rely on lances cooperating with ledges along one or more walls of the passageway to resist withdrawal in a direction opposed to the direction of insertion, and the lances commonly are deflectable during insertion until passing the ledge whereafter the lances resile for a free end thereof to abut the ledge to define a positive stop. Such contacts can be found in U.S. Pat. Nos. 5,362,260 and 5,899,775. However, the contacts having such lances for retaining the contacts in the corresponding passageways are usually complex to be produced which in turn increases the manufacture cost, and the whole contact reliability will be decreased after repeated engagements with a complementary terminal.

Another kind of contacts, which are relatively thin and longitudinally elongated, usually has a body portion including side edges. Each side edge is provided with one or more laterally projecting barbs. These barbs engage the respective sides of the passageway in a housing to affect an interference or press-fit therebetween, thereby retaining the contact within its respective passageway. Such contacts are widely employed and are disclosed, for example, in U.S. Pat. Nos. 5,263,882, 5,112,233 and 5,064,391. As the size of the electrical connectors decreases, it has become extremely desirable for connectors to have closely spaced and small contacts. As a result, the barbs on the contacts may not provide the desired retention force, especially where the electrical connector is intended for repeated "make and break" engagement over an extended period of time. Moreover, if the walls partitioning the passageways are relatively thin to conserve space, barbs on the contacts can break through the wall and electrically contact with the adjacent contact. Obviously, this will cause short circuit.

U.S. Pat. No. 5,403,215 discloses still another kind of contact, which has an intermediate body portion provided with respective side edges formed with a protruding convex portion and a recessed concave portion, respectively. The contacts are slideably inserted into respective channels in an insulative housing, the channels being separated by respective walls. When the contacts are thus inserted into the channels, the convex portion of an adjacent contact to trap and deform the wall therebetween, thereby exerting a resilient biasing force for retaining each contact in its respective channel. However, the contacts having such retention means are not reliable enough if subjected to strong shake, vibration or after repeated engagements with complementary contacts.

Hence, an electrical connector having improved contact retention is highly desired to overcome the disadvantages of the prior art.

BRIEF SUMMARY OF THE INVENTION

Accordingly, it is an object of the present invention to provide an electrical connector with improved contact retention for firmly securing the contacts in a housing thereof.

In order to achieve the above-mentioned object, an electrical connector in accordance with the present invention, comprises an insulative housing and a plurality of terminals received in the housing. The insulative housing defines a plurality of terminal receiving channels. Each terminal receiving channel has an inner face and a pair of step portions oppositely protruding from the inner face and extending in a longwise direction. The conductive terminals each comprise a body portion having two opposed side edges, a pair of spaced-apart legs extending from the body portion, and a tail portion extending from the body portion along a direction away from the legs. Each side edge of the terminal comprises a shoulder and a recessed portion next to the shoulder. The step portion is depressed and collapsed by the shoulder when the terminal is inserted into the terminal receiving channel and part of the step portion is pressed into the recessed portions of the terminal, thereby securing the terminal in the housing under an engaging force between the depressed step portions of the housing and the recessed portions of the terminal.

Other objects, advantages and novel features of the invention will become more apparent from the following detailed description of the present embodiment when taken in conjunction with the accompanying drawings.

DETAILED DESCRIPTION OF THE PREFERRED EMBODIMENT

Figure 1:
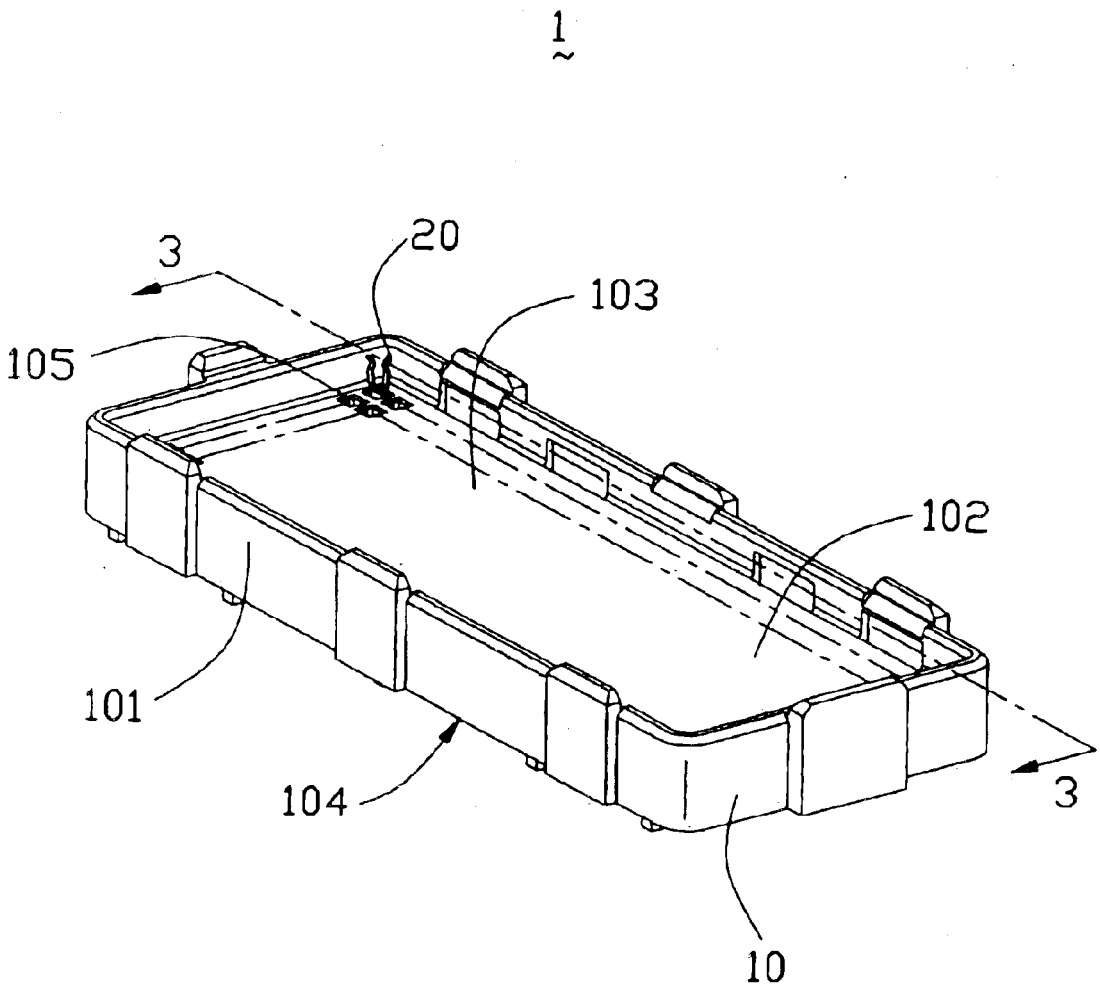
FIG. 1 is a perspective view of an electrical connector in accordance with the present invention.

Reference will now be made to the drawing figures to describe the present invention in detail.

With reference to FIG. 1, an electrical connector 1 in accordance with the present invention comprises an insulative housing 10 having side walls 101 interconnecting with each other and a closed bottom wall 102. The bottom wall 102 defines a mating face 103 on a top thereof adapted for mating with a complementary connector (not shown) and a mounting face 104 opposite to the. mating face 103 adapted for seating on a circuit board (not shown). A plurality of terminal receiving channels 105, which are arranged in multiple rows, extend from the mating face 103 to the mounting face 104 for correspondingly receiving a plurality of terminals 20. For simplicity, only few terminal receiving channels 105 and one exemplary terminal 20 are shown.

Figure 2:
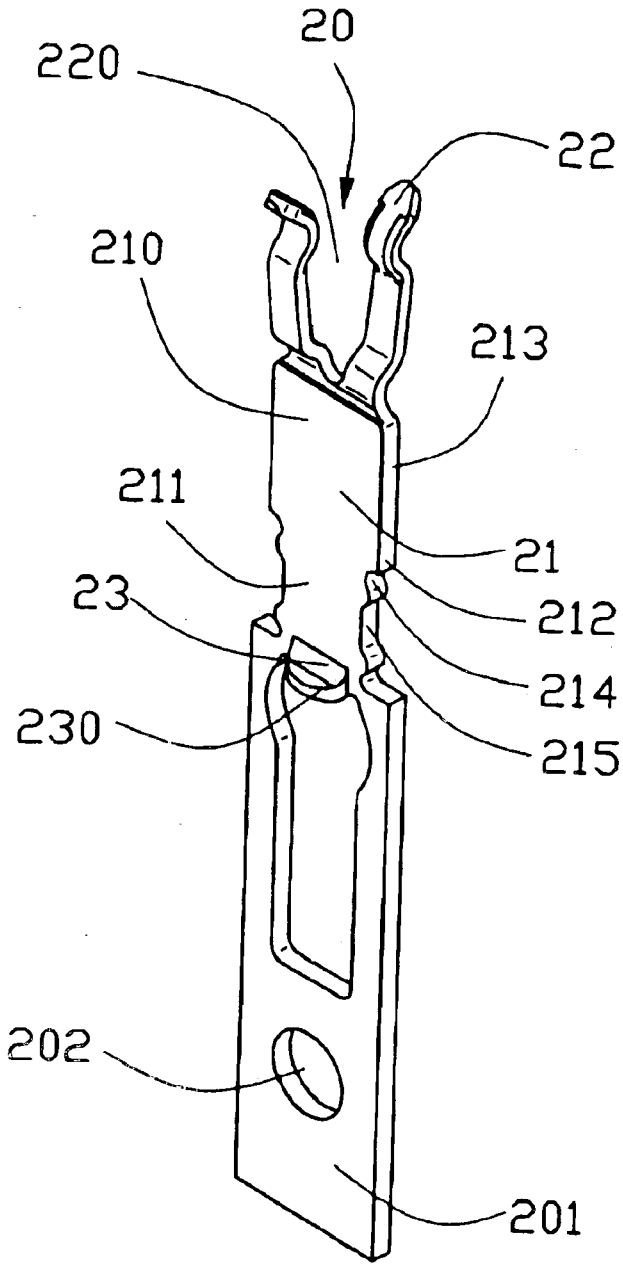
FIG. 2 is a perspective view of a terminal with a carrier connected thereto.

FIG. 2 illustrates a terminal 20 having a carrier 201 connected therewith. The carrier 201 defines an aperture 202 for engaging with a driving wheel (not shown) by which the carrier 201 can be moved. The terminal 20 is stamped out and formed from a suitable metal sheet and has a relatively thin cross section. The terminal 20 includes an elongate body portion 21 of a rectangular shape, a pair of spaced-apart mating legs 22 extending from an upper end of the body portion 21, and a tail portion 23 extending from a lower end of the body portion 21 in a direction away from the legs 22.

The body portion 21 comprises an upper portion 210 and a lower portion 211. The width of the upper portion 210 is bigger than the width of the lower portion 211 thereby a shoulder 212 being formed along the longwise direction of either side edge 213 of the body portion 21 and a recessed portion 214 being formed under the shoulder 212.

Continue to FIG. 2, the two spaced-apart mating legs 22 defines therebetween a receiving space 220 for trapping a complementary mating contact of the complementary connector. The tail portion 23 of the terminal 20 is provided with a solder pad 230 having a substantially circular-shaped cross section. As more clearly shown in FIG. 4, a solder ball 24 is attached onto the solder pad 230 for soldering the terminal 20 to circuits of the circuit board on which the connector 1 is mounted. It should be noted here that although FIG. 4 shows the solder ball 24 is fused to the solder pad 230 before the terminal 2 is assembled into the housing 10, the solder ball 24 can also be fused to the solder pad 230 after the contact 2 is assembled to the housing 10.

Figure 3:
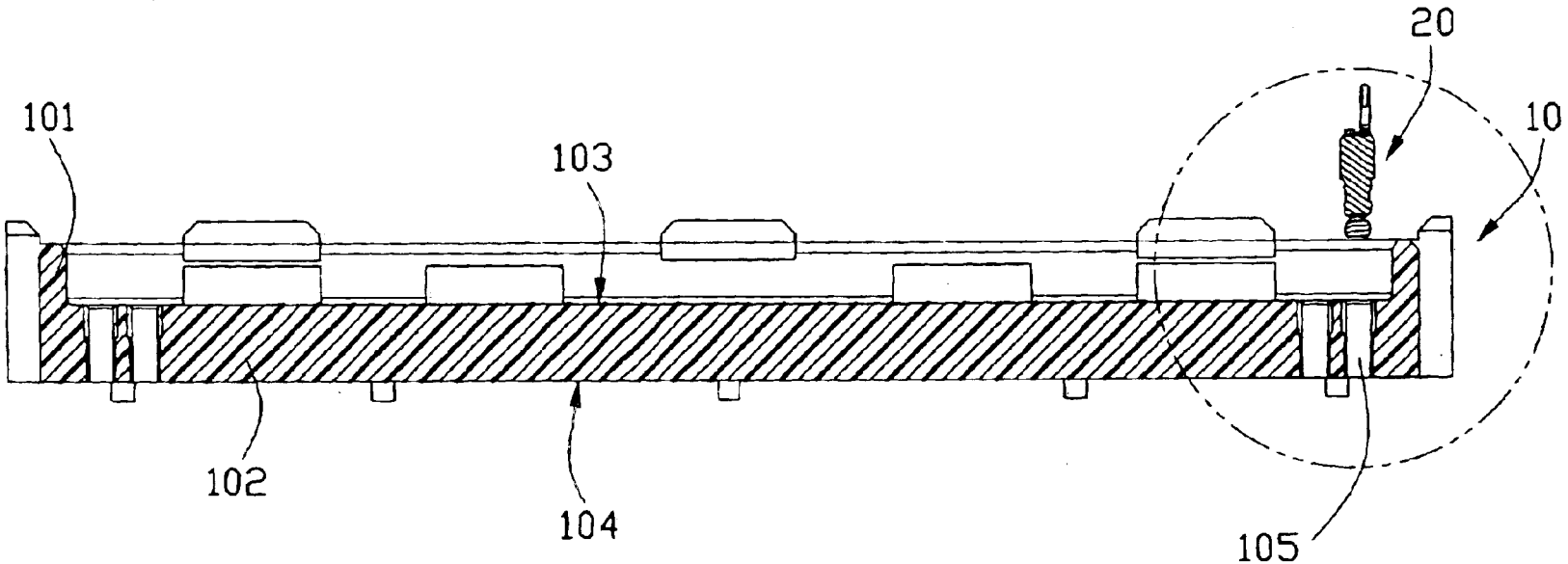
FIG. 3 is a sketch, cross-sectional view of the electrical connector taken along line 3—3 of FIG. 1 showing a terminal prepared to be inserted into a channel of the connector.
Figure 4:
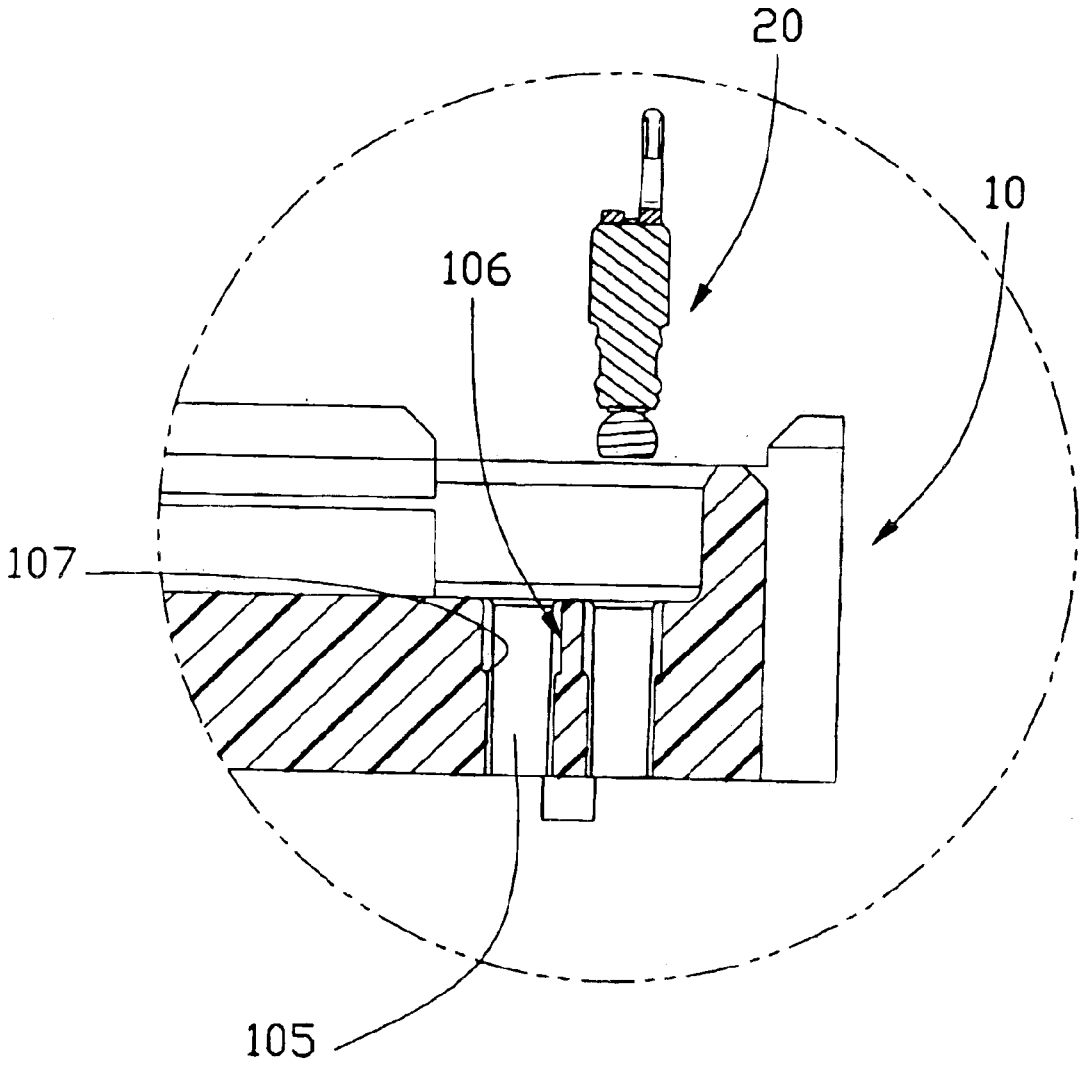
FIG. 4 is a partially enlarged view of the electrical connector shown in FIG. 3.

With reference to FIGS. 3–4, each terminal receiving channel 105 of the housing 10 has an inner face 106 and a pair of opposite, deformable step portions 107 protruding from the inner face 106 into the channel 105 and extending along a longwise direction of the channel 105.

Figure 5:
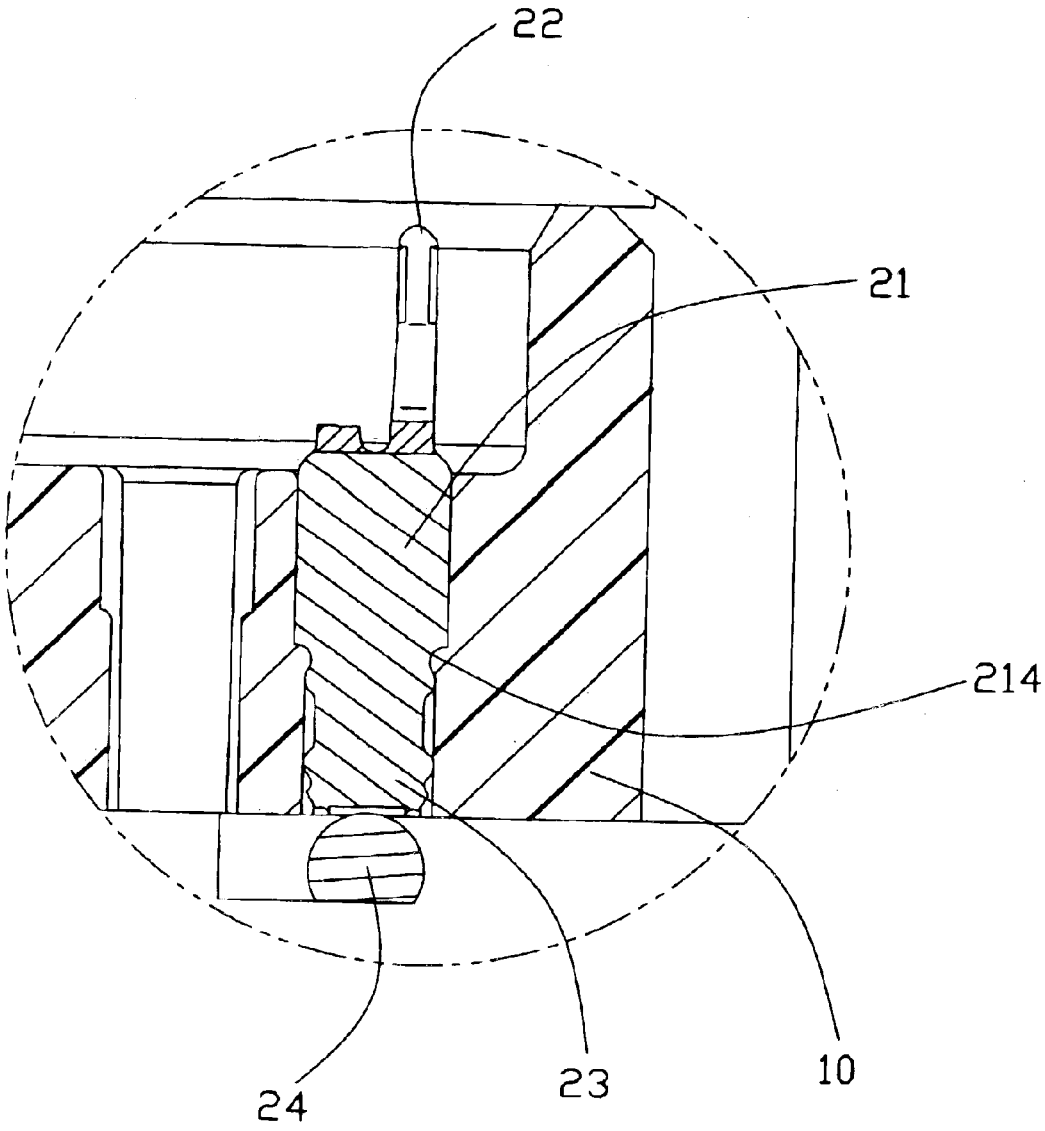
FIG. 5 is a partially enlarged view of the electrical connector showing the terminal is assembled into the channel of the connector.

Together referring to FIGS. 4 and 5, when the terminal 20 is inserted into the respective terminal receiving channel 105 from the mating face 103 of the housing, the shoulders 212 of the two opposite side edges 213 of the terminal 20 press the step portions 107 of the channel 105 toward the mounting face 104, which lead to the step portions 107 being depressed and collapsed and part of the step portions 107 are pressed into the recessed portions 214 of the terminal 20. Therefore, the terminal 20 is permanently secured in the corresponding channel 20 under the engaging force between the depressed step portions 107 of the housing 10 and the recessed portion 214 of the terminal 20.

Turn back to FIG. 2 in conjunction with FIGS. 4–5, a pair of indents 215 are further defined in the opposite side edges 213 of the terminal 20 adjacent to the recessed portions 214, respectively. It is worth noting that the redundant material of the depressed step portion 107 can be further pressed into the indents 215 of the terminal 20 if the corresponding recessed portions 214 have been filled up with the material of the depressed step portion 107.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and.arrangement of parts within the principles of the invention to the full extent indicated by the broad general meaning of the terms in which the appended claims are expressed.

We claim:

1. An electrical connector comprising:

an insulative housing defining a mating face, a mounting face opposite to the mating face, and a plurality of terminal receiving channels extending from the mating face to the mounting face, each channel having at least one deformable step portion formed on an inner face thereof; and a plurality of conductive terminals each having a body portion of an elongate, rectangular shape, the body portion comprising an upper portion and a lower portion, a width of the upper portion being bigger than a width of the lower portion thereby a shoulder being formed along a longwise direction and a recessed portion being formed under the shoulder, such that the shoulder press the step portion of the channel downwardly, which lead to the step portion being depressed and collapsed, during the insertion of the terminal from the mating face of the housing into the channel, and such that part of the step portion is pressed into the recessed portion of the terminal, thereby providing a permanently engaging force between the depressed step portion of the channel and the recessed portion of the terminal, each terminal comprises a pair of spaced-apart legs projecting from the body portion and extending beyond the mating face of the housing and adapted for mating with a complementary contact, each terminal has a tail portion extending from the body portion along a direction away from the spaced-apart legs and the tail portion of each terminal has a solder pad having a circular-shaped cross section and a solder ball attached on the solder pad.

2. An electrical connector comprising:

an insulative housing defining opposite first and second faces thereon and a plurality of terminal receiving channels extending therethrough, each of said terminal receiving channels defining first a first section and a second along a lengthwise direction thereof, the first section being closer to the first face and the second section closer to the second face, the first section being wider than the second section; and a plurality of terminals retainably disposed in the corresponding channels, respectively, each of said terminals including a first portion and a second portion along said lengthwise direction and respectively snugly received in the first section and the second section, the first portion being wider than the second portion, at least one recess formed around a joint portion between the first portion and the second portion; wherein during assembling, the terminal is inserted into the corresponding channel along an insertion direction from the first face to the second face, and a joint section of the housing between the first section and the second section is either deformed or collapsed to be embedded within the recess for preventing movement of the terminal relative to the corresponding channel along said lengthwise direction and wherein deformation or collapse of said joint section results from movement of the first portion in said insertion direction.

* * * * *